United States Patent [19]

Ota et al.

[11] Patent Number: 4,700,682

[45] Date of Patent: Oct. 20, 1987

[54] FUEL VAPOR CONTROL DEVICE

[75] Inventors: Isamu Ota, Toyota; Yutaka Nishimura, Okazaki; Shigeru Nishio, Kariya; Kenji Yogo, Nagoya, all of Japan

[73] Assignees: Toyota Jidosha Kabushiki Kaisha, Toyota; Aisin Seiki Kabushiki Kaisha, Kariya, both of Japan

[21] Appl. No.: 819,606

[22] Filed: Jan. 17, 1986

[30] Foreign Application Priority Data

Jan. 18, 1985 [JP] Japan ..... 60-004086

[51] Int. Cl.[4] ..... F02M 33/02

[52] U.S. Cl. ..... 123/516; 123/519

[58] Field of Search ..... 123/516, 519, 520; 261/DIG. 67

[56] References Cited

U.S. PATENT DOCUMENTS

| | | | |
|---|---|---|---|
| 2,917,110 | 12/1959 | Brohl | 123/516 |
| 3,645,443 | 2/1972 | Willson et al. | 236/34 |
| 4,157,366 | 6/1979 | Ruth | 123/520 |
| 4,395,991 | 8/1983 | Miyachi | 123/520 |
| 4,577,607 | 3/1986 | Nishio | 123/519 |

FOREIGN PATENT DOCUMENTS

| | | | |
|---|---|---|---|
| 3418392 | 12/1984 | Fed. Rep. of Germany | 123/516 |

*Primary Examiner*—Ronald B. Cox

*Attorney, Agent, or Firm*—Finnegan, Henderson, Farabow, Garrett & Dunner

[57] ABSTRACT

A fuel vapor control device having a valve opening and closing a passage connecting a carburetor and a charcoal canister according to a predetermined temperature. A first coil spring formed by a "shape memory effect" alloy is provided to urge the valve to open the passage when the temperature is high. A second coil spring urges the valve to close the passage. A solenoid is provided to urge an armature against the valve to close the passage against the force of the first coil spring when the engine is running. The solenoid heats the first coil spring to generate a spring force therein when the engine is running. When the engine is turned off, the solenoid is deactivated, and the force of the first spring overcomes the force of the second spring to open the passage until such time as the temperature of the first spring drops below the predetermined temperature.

2 Claims, 3 Drawing Figures

FUEL VAPOR CONTROL DEVICE

BACKGROUND OF THE INVENTION

1. Field of the Invention

The present invention relates to a fuel vapor control device which feeds vaporized fuel generated in a float chamber of a carburetor to a charcoal canister so that the vaporized fuel is absorbed in the charcoal canister during the time in which an engine is stopped.

2. Description of the Related Art

The fuel vapor control device feeds vaporized fuel generated in the float chamber of a carburetor to the charcoal canister to be absorbed therein when the engine is stopped, in order to prevent the intake system of the engine from being filled with the vaporized fuel. If the intake system is filled with the vaporized fuel, the air-fuel mixture becomes overrich when starting the engine, and thus it becomes difficult to start the engine. However, as almost all light gasolines have a low boiling point, i.e., vaporize at a low temperature, if the float chamber communicates with the charcoal canister for the whole period during which the engine is stopped, the amount of fuel vapor in the intake system is decreased to a point where it becomes difficult to start the engine after it has been stopped for a long time.

Japanese Unexamined Utility Model Publication No. 53-152020 shows a construction in which a passage connecting the float chamber and the charcoal canister is opened and closed according to the temperture of the cooling water of the engine, so that the vaporized fuel does not flow into the charcoal canister when the engine temperature is relatively low, i.e., a temperature at which light gasoline is vaporized. In this construction, a valve opens a passage connecting the float chamber and the charcoal canister when the temperature is higher than the predetermined value. That is, the valve opens from just after the engine is stopped and the temperature affecting the valve is above the predetermined value, until the temperature affecting the valve drops below that predetermined value.

In the above described conventional device, if the temperature at which the valve opens is set to a higher value to advance the time at which the valve is close, so as to improve the starting of the engine after it has been stopped for a long time, the time at which the valve opens just after the engine is stopped is delayed. Therefore, just after the engine is stopped, the intake system of the engine is filled with vaporized fuel generated in the float chamber of the carburetor, and thus the engine becomes difficult to start when hot. Conversely, if the temperature at which the valve opens is set to a lower value to enable the engine to be easily started just after the engine is stopped, the time at which the valve closes again after the engine has been stopped for a long time is delayed. As a result, the valve is open for a longer period and thus the amount of light gasoline vapor generated in the float chamber of the carburetor is decreased, making it more difficult to start the engine when cold. The above construction will be explained in more detail later, with reference to the drawings.

SUMMARY OF THE INVENTION

Accordingly, an object of the present invention is to provide a fuel vapor control device by which the starting of an engine when the engine is hot or cold is improved.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the fuel vapor control device of this invention comprises a valve for opening and closing the passage between a carburetor and a charcoal canister, a first coil spring for urging the valve in a direction to close the passage, a second coil spring made of a shape memory effect alloy for urging the valve in a direction to open the passage against the first coil spring when the temperature affecting the second coil spring exceeds a predetermined value, a solenoid coil, a cylindrical guide disposed in the solenoid coil, and an armature slidably supported in the guide, the armature moving in response to the energization and deenergization of the solenoid coil to apply pressure against the valve and release such pressure from the valve, a solenoid coil heating the second coil spring above a predetermined value when the engine is running, and the armature when the engine is running exerting a force which keeps the valve shut against the force exerted by the second coil spring.

The heat from the solenoid coil causes the second coil spring to deform and urge the valve to open against the first coil spring when the temperature of the engine is higher than a predetermined value just after the engine has stopped.

BRIEF DESCRIPTION OF THE DRAWINGS

The present invention may be more fully understood from the description of the preferred embodiment of the invention set forth below, together with the accompanying drawings, in which.

DESCRIPTION OF THE PREFERRED EMBODIMENT

Before describing the embodiment of the present invention, the operation and construction of a prior art fuel vapor control device will be described.

Japanese Unexamined Utility Model Publication No. 53-152020 shows a construction in which a passage connecting the float chamber and the charcoal canister in opened and closed according to a temperature of a cooling water of the engine, so that the vaporized fuel does not flow into the charcoal canister when the engine temperature is relatively low, i.e., a temperature at which light gasoline is vaporized. The operation of this device is described below with reference to FIG. 3 herein. In this Figure, a chained line I shows changes in the temperature affecting the fuel vapor control device over a period of time. As understood from FIG. 3, the valve opens the passage connecting the float chamber and the charcoal canister when the temperature is higher than $d_2$. That is, the valve opens from the time $t_1$ when, just after the engine is stopped, the temperature affecting the valve rises above $d_2$ to the time $t_3$ when the temperature affecting the valve drops below $d_2$.

In the above described conventional device, if the temperature $d_2$ at which the valve opens is set to a higher value to advance the time $t_3$ at which the valve is closed, to improve the starting of the engine after it has been stopped for a long time, the time $t_1$ at which the valve opens just after the engine is stopped is delayed. Therefore, just after the engine is stopped, the intake system of the engine is filled with vaporized fuel, and thus the air gas mixture becomes overrich so that the engine becomes difficult to start. Conversely, if the temperature $d_2$ is set to a lower value to enable the engine to be easily started just after the engine is stopped, the time $t_3$ at which the valve closes again after the engine has been stopped for a long time is delayed. As a result, the valve is open for a longer period, and thus the amount of light gasoline vapor in the intake system is decreased, making it more difficult to start the engine.

An embodiment of the present invention will now be described with reference to FIGS. 1 and 2.

Figure 1:
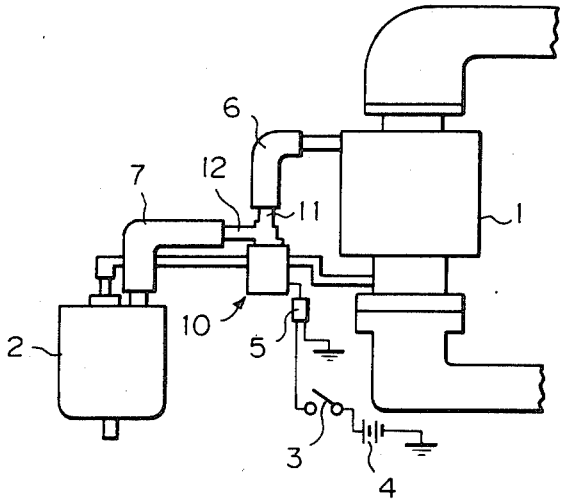
FIG. 1 is a side view of a fuel vapor control device constructed in accordance with the present invention connected in place in an automotive fuel system.

FIG. 1 shows an arrangement of a fuel vapor control device 10 according to the present invention, and peripheral devices thereof. An inlet port 11 of the fuel vapor control device 10 communicates with a float chamber (not shown) of a carburetor 1 through a tube 6, and an outlet port 12 of the fuel vapor control device 10 communicates with a charcoal canister 2 through a tube 7. The fuel vapor control device 10 is connected to a battery 4 through a connector 5 and an ignition key switch 3 of the engine. When the switch 3 is closed, the battery 4 applies a voltage to a solenoid (described later) of the fuel vapor control device 10 through the connector 5. As is well known, when the engine is stopped, a valve (described later) of the fuel vapor control device 10 opens the tubes 6 and 7 connected to the carburetor 1 and the charcoal canister 2, respectively, so that vaporized fuel generated in the float chamber of the carburetor 1 is fed to the charcoal canister 2 and absorbed therein.

Figure 2:
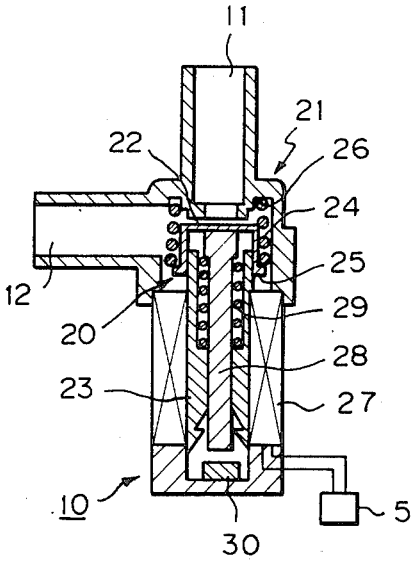
FIG. 2 is a sectional view of the embodiment of the fuel vapor device of the present invention.

FIG. 2 shows in cross-section the embodiment of the fuel vapor control device 10 of FIG. 1 constructed according to the present invention. An inverted cup-shaped metal valve 20, having an open and a closed ends, is housed in a housing 21 having inlet and outlet ports 11 and 12 formed in such a manner that the closed end 22 of the valve 20 opens and closes the inlet port 11. The inner surface of the open end of the valve 20 is slidably fitted over the outer surface of a metal guide 23 provided below and coaxially to the inlet port 11. A temperature sensing member, e.g., a first coil spring 24 is provided between a flange 25 formed on the outer periphery of the open end of the valve 20 and an annular groove 26 formed around the outer surface of the opening of the inlet port 11. The first coil spring 24 is formed by a "shape memory effect" alloy which will extend and generate a spring force when the temperature affecting the coil spring 24 rises above the predetermined value (for example, 65° C.) and will contract to a constant length when that temperature drops below the predetermined value. Namely, the coil spring 24 urges the valve 20 to open, and accordingly, open the inlet port 11 when the temperature affecting the coil spring 24 is above the predetermined value.

A solenoid coil 27 is provided around the guide 23, and a rod shaped armature 28 is slidably inserted in the guide 23. A second coil spring 29 is provided between the guide 23 and the armature 28 to urge the armature 28 upward and in contact with the valve 20. Voltage to the solenoid coil 27 is applied by the battery 4 through the connector 5. When energized by the application of a voltage, the solenoid coil 27 urges the armature 28 upward, and when the application of the voltage is stopped, the solenoid coil 27 is deenergized and releases the upward pressure on the armature 28. When energized the solenoid coil 27 generates heat, and this heat is transmitted to the coil spring 24 through the guide 23 and the valve 20. Note, a stopper 30 is formed on a bottom surface of the housing 21 and under the armature 28, to limit the amount of downward movement by the armature 28.

The fuel vapor control device 10 according to the present invention operates as follows.

When the engine is running, a voltage is always applied to the solenoid coil 27 so that the armature 28 is constantly urged upward. Therefore, the valve 20 is pushed up by the armature 28 to close the inlet port 11 while the engine is running. At the same time, heat generated by the solenoid coil 27 is transmitted to the first coil spring 24 through the guide 23, the valve 20, and other portions, so that the first coil spring 24 is heated to a temperature higher than a predetermined value and thus is extended and thereby generates a spring force to cause the valve 20 to open the inlet port 11. However, the valve 20 is prevented from opening the inlet port 11 by the armature 28 which is urged upward by the solenoid 27, to keep the inlet port 11 closed in spite of the force exerted by the first coil spring 24. Accordingly the tubes 6 and 7 are also closed by the valve 20 when the engine is running.

When the engine is stopped, the voltage applied to the solenoid coil 27 is shut off to release the force urging the armature 28 upward. However, although the armature 28 is still urged upward against the valve 20 by the second coil spring 29, the valve 20 is urged downward by the first coil spring 24 to open the inlet port 11. Namely, when the engine is stopped, cooling air blowing onto the fuel vapor control device 10 also is stopped, and accordingly, the temperature around the fuel vapor control device 10 rises. This causes the temperature of the first coil spring 24 to rise, extending the spring 24 and exerting a downward force larger than the upward force exerted by the second coil spring 29.

Figure 3:
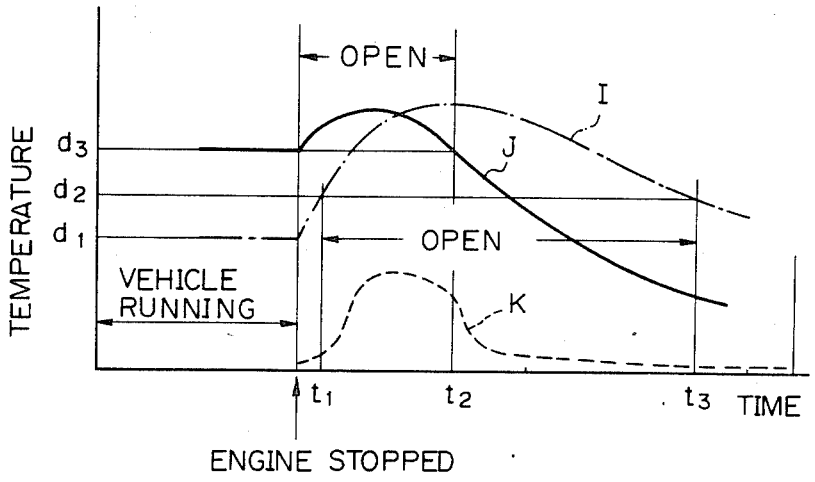
FIG. 3 is a graph showing variation of temperature near a fuel vapor control device and the corresponding open-close actions of a valve.

The temperature affecting the first coil spring 24, i.e., the temperature around the fuel vapor control device 10 is shown in FIG. 3 by the solid line J. In this embodiment, the first coil spring 24 will open the valve 20 when the temperature of the first coil spring 24 is higher than $d_3$, which is higher than $d_2$. Therefore, the valve 20 opens the inlet port 11 substantially at the time when the engine is stopped, as shown in FIG. 3. Then when the temperature of the engine drops, and accordingly, the temperature of the coil spring 24 falls below the predetermined temperature $d_3$, the coil spring 24 returns to its original length and no longer exerts the downward force. As a result, the valve 20 is moved upward by the second coil spring 29 to close the inlet port 11. The time $t_2$ when the inlet port 11 is closed by the valve 20 is, for example about 40 minutes after the engine is stopped, this time $t_2$ being very advanced as compared to the time $t_3$ at which the valve of the conventional device closes. In FIG. 3, the broken line K shows the quantity of fuel vapor generated in the carburetor 1. As can be understood from the figure, according to this embodiment, the valve 20 opens the inlet port 11 when the quantity of fuel vapor generated is relatively large.

Note, the first coil spring 24 may be heated by means other than the solenoid coil 27.

As described above, since the tubes connecting the carburetor and the charcoal canister are opened at almost the same time as the engine is stopped, starting the engine at a relatively high temperature becomes easy. For example, the engine is easily started within a period of 5 or 6 minutes after the engine is stopped. Further, even if the engine is stopped for a long time, since the light gasoline vapor generated in the float chamber of the carburetor 1 is effectively restrained, the engine is easily started. This will give remarkable effects when the device is used in low temperature conditions.

Although embodiments of the present invention have been described herein with reference to the attached drawings, many modifications and changes may be made by those skilled in this art without departing from the scope of the invention.

We claim:

1. A fuel vapor control device for controlling the flow of vaporized fuel from a carburetor through a passage to a charcoal canister, said fuel vapor control device comprising:

a valve for opening and closing the pasage between said carburetor and said charcoal canister;

a first coil spring for urging said valve in a direction to close said passage;

a second coil spring made of a shaped memory effect alloy for urging said valve in a direction to open said passage against said first coil spring when the temperature affecting said second coil spring exceeds a predetermined value;

a solenoid coil, a cylindrical guide disposed in said solenoid coil, and an armature slidably supported in said guide, said armature moving in response to the energization and deenergization of said solenoid coil to apply pressure against said valve and release such pressure from said valve; and said solenoid coil heating said second coil spring above said predetermined value when said engine is running, and said armature when said engine is running exerting a force which keeps said valve shut against the force exerted by said second coil spring.

2. A fuel vapor control device according to claim 1, wherein heat generated in said solenoid coil is transmitted to said second coil spring through said guide and said valve

* * * * *